US010654627B2

(12) United States Patent
Feeley et al.

(10) Patent No.: US 10,654,627 B2
(45) Date of Patent: May 19, 2020

(54) SPILL-PROOF LID FOR CONTAINER

(71) Applicant: GoSili, Inc., Traverse City, MI (US)

(72) Inventors: Anastacia Feeley, Traverse City, MI (US); Giuliana Schwab, Studio City, CA (US)

(73) Assignee: GoSili, Inc., Traverse City, MI (US)

( * ) Notice: Subject to any disclaimer, the term of this patent is extended or adjusted under 35 U.S.C. 154(b) by 0 days.

(21) Appl. No.: 16/291,758

(22) Filed: Mar. 4, 2019

(65) Prior Publication Data

US 2019/0270550 A1 Sep. 5, 2019

Related U.S. Application Data

(60) Provisional application No. 62/637,538, filed on Mar. 2, 2018.

(51) Int. Cl.

| | |
|---|---|
| ***B65D 47/06*** | (2006.01) |
| ***B65D 43/02*** | (2006.01) |
| ***B65D 53/06*** | (2006.01) |
| ***B65D 47/20*** | (2006.01) |

(52) U.S. Cl.

CPC ..... *B65D 47/06* (2013.01); *B65D 43/022* (2013.01); *B65D 43/0229* (2013.01); *B65D 47/2031* (2013.01); *B65D 53/06* (2013.01); *B65D 2251/026* (2013.01); *B65D 2543/00046* (2013.01); *B65D 2543/00092* (2013.01); *B65D 2543/00296* (2013.01); *B65D 2543/00518* (2013.01); *B65D 2543/00546* (2013.01)

(58) Field of Classification Search

CPC .... B65D 47/06; B65D 47/26; B65D 47/2031; B65D 47/2025; B65D 43/022; B65D 43/0229; B65D 2543/00046; B65D 2543/00518; B65D 2543/00546; B65D 2543/00296; B65D 2543/00092; B65D 2251/026; B65D 53/06

USPC ..... 222/478, 490, 491, 494; 220/703, 220/711–718; 215/11.5, 11.4, 387

See application file for complete search history.

(56) References Cited

U.S. PATENT DOCUMENTS

| | | | | |
|---|---|---|---|---|
| 2,623,368 | A * | 12/1952 | Olsen | A47G 19/2272 220/711 |
| 3,490,488 | A * | 1/1970 | Grist | B60T 17/04 137/512.4 |
| 5,186,347 | A | 2/1993 | Freeman et al. | |
| 5,890,619 | A * | 4/1999 | Belanger | A47G 19/2272 220/713 |
| 6,102,245 | A | 8/2000 | Haberman | |
| 9,241,588 | B2 * | 1/2016 | Dunn | A47G 19/2272 |
| 2004/0124196 | A1 * | 7/2004 | Ziegler | A47G 19/2272 220/288 |

(Continued)

OTHER PUBLICATIONS

International Search Report and Written Opinion of the International Searching Authority prepared by the USPTO in connection with PCT/US2019/020601, dated May 3, 2019; Entire Document (12 pages).

*Primary Examiner* — Lien M Ngo

(74) *Attorney, Agent, or Firm* — Richards Patent Law P.C.

(57) ABSTRACT

The present disclosure provides a lid that has a design that is configured to enable drinking from any point along the perimeter of the lid while at the same time preventing liquid to escape from the lid when a user is not drinking (i.e., spill proof). The lid has a plurality of slits around at least a portion of the lid.

9 Claims, 3 Drawing Sheets

(56) References Cited

U.S. PATENT DOCUMENTS

| | | | | |
|---|---|---|---|---|
| 2005/0145636 | A1* | 7/2005 | Albright | A47G 19/2272 220/714 |
| 2005/0252923 | A1 | 11/2005 | Woolf | |
| 2010/0270322 | A1 | 10/2010 | Lieberman et al. | |
| 2013/0186918 | A1* | 7/2013 | Menceles | B65D 41/0407 222/567 |
| 2017/0253363 | A1 | 9/2017 | Feeley et al. | |

* cited by examiner

SPILL-PROOF LID FOR CONTAINER

CROSS-REFERENCE TO RELATED APPLICATIONS

This application incorporates by reference and claims the benefit of priority to U.S. Provisional Application 62/637,538 filed on Mar. 2, 2018.

BACKGROUND OF THE INVENTION

The present subject matter relates generally to a spill proof lid for a container.

Beverage containers are ubiquitous for use in "on-the-go" consumption of liquids, particularly hot beverages such as coffee or tea. Various lid designs include openings therein, or openable portions therein, configured with the idea of minimizing splashing or spilling of the beverage from the container.

One type of lid that is now widely used is a drink-through type lid that provides a horizontally oriented drink outlet on a top surface of a raised rim. Such a design allows a user to drink through the lid in a manner similar in many respects to drinking through a straw, in that it usually seems that a limited amount of liquid is provided through the small opening. Unfortunately, and especially during transport, lids with such openings may allow escape of liquid (especially when full), unless the drink outlet is sealed, such as by use of a stopper or plug. Consequently, spill prevention devices used with such designs do not allow drinking without subsequent removal of the stopper or plug. Similarly, other lids have been provided that include flip-open or rip-open tabs that lift to allow drinking, but which prevent drinking when such tabs are in an unopened or in a resealed condition.

Conventional no-spill lids comprising valves suffer from a variety of disadvantages. For example, no-spill valves are typically constructed of multiple pieces that are relatively difficult to clean. For example, in conventional containers including an inlet and outlet valve, the valves are difficult to clean. Further, many conventional containers that include plastic valve parts are not dishwasher safe and cannot be boiled for sterilization.

Moreover, some of these no-spill valves have both an inlet valve and an outlet valve and thus require even more parts, which increases both the material and manufacturing costs associated with the valves. In an effort to reduce costs, one-piece valves constructed of a silicon material have been developed. However, some of these one-piece valves include a perforation formed in the valve that allows fluid to flow into and out of the drinking cup. These perforations, however, are prone to leakage, particularly if the drinking cup into which the valve is incorporated is tipped over. This is because there is no structure for sealing off the perforation as the valve operates by the opening and closing of the perforation itself. Further, systems that provide a rubber flap covering the openings to prevent spills require an additional element (the flap), additional materials, and, thus, increase the cost of manufacturing.

Improvements over these valves have included a single piece solid valve that is releasably engageable with the lid of a drinking cup. In this configuration, the valve is located beneath or in communication with a spout, typically constructed of a plastic, in a drinking lid. The valve can be constructed entirely of silicon or may alternatively be a silicon diaphragm disposed within a plastic housing.

Thus, there remains a need to provide a lid design for a container that simultaneously minimizes or avoids spill of liquid from the beverage cup or container, while allowing the user to drink from the cup or container without first manipulating a flip-open or rip-open tab. Further, a need exists for a one-piece lid assembly that virtually eliminates leakage through the lid.

BRIEF SUMMARY OF THE INVENTION

The present disclosure provides a lid for a container. Various examples of the device are provided herein.

The present disclosure provides a lid that has a design that is configured to enable drinking from any point along the perimeter of the lid while at the same time preventing liquid to escape from the lid when a user is not drinking (i.e., spill proof). The lid has a plurality of slits around at least a portion of the lid.

In an example, the number of slits is an amount that the slits are spaced enough apart for structural integrity, but close enough such that no matter which point of the lip the user decides to drink from, the user will access at least one slit from which to drink. The slits are along the outer edge of the lid, wherein the thicker part of the outer side wall of the lid can create structural integrity to prevent tearing along the slit. In an example, the slits are created within the lid post production of the lid. In an example, the slits can be from one edge of a rim to the opposite edge of the rim.

The slits are generally not visible. In other words, the slits remain closed when a user is not drinking from the lid. As a result, the lid is spill proof.

Although the primary example in the disclosure is directed to a lid, the disclosure contemplates applicability to any container cap or lid, including bottle caps, coffee cup lids, disposable beverage lids, disposable beverage caps, baby bottles and nipples, among others.

An advantage of the present lid is that it is easier to clean and use, as it is made out of one material, silicone, and is one-piece.

An additional advantage of the present lid includes improved dental development of children. Pediatric dentists have found for oral development, it is best to have children drink from cup shaped lids rather than inserting a sippy spout, especially hard plastic sippy spouts, that adversely affect the development of the teeth of children.

Another advantage of the present lid is providing a no-spill drinking product that minimizes and/or eliminates accidental or undesirable liquid flow or spillage.

A further advantage of the present lid is that it is only one piece and does not have small holes or additional parts for liquid or solids to get trapped in, making it difficult to clean.

A further advantage of the present lid is that it can withstand high heat to sterilize (e.g., boiled).

Another advantage of the present lid is that it can be inverted (flipped inside out) for cleaning.

Yet another advantage of the present lid is the absence of a valve that controls access to the liquid. By not including a valve, the lid is easier to clean and more cost and labor efficient to manufacture.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
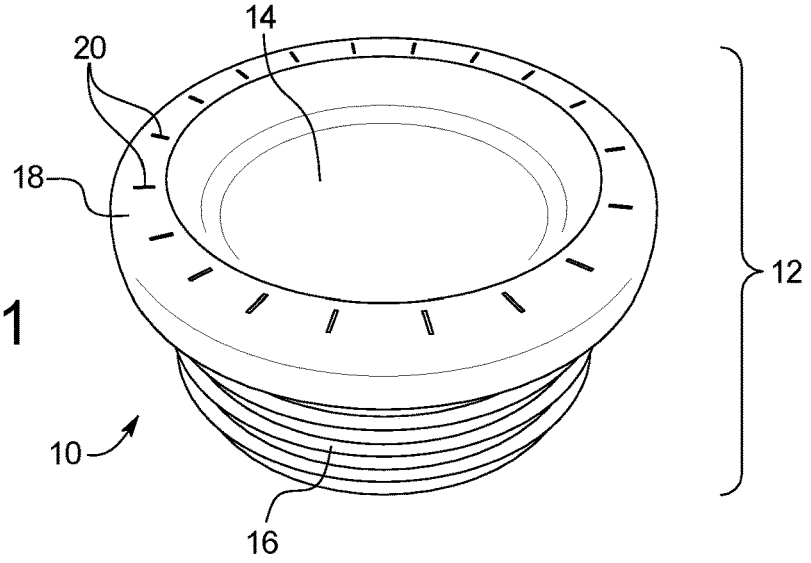
FIG. 1 is a top perspective view of an example of the lid disclosed herein.
Figure 2:
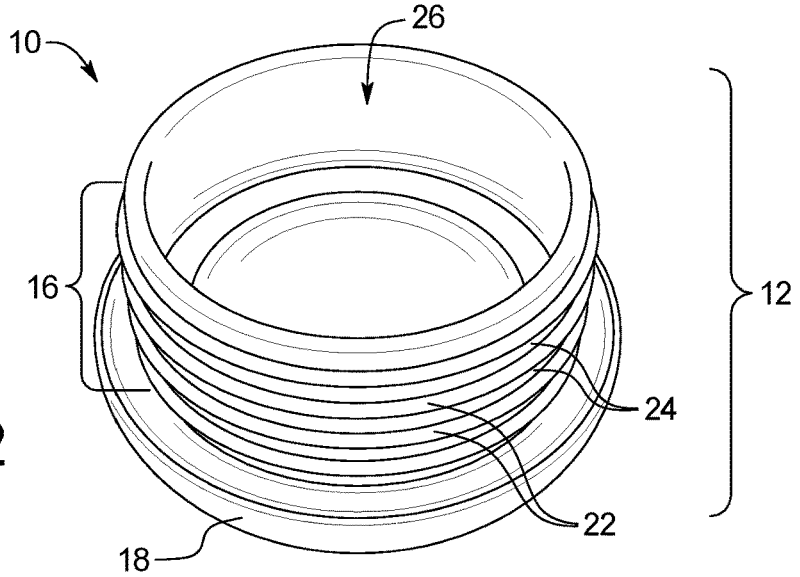
FIG. 2 is a bottom perspective view of an example of the lid disclosed herein.
Figure 3:
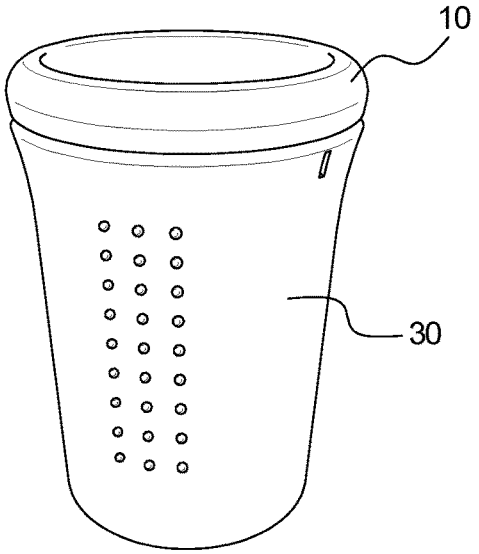
FIG. 3 is a perspective view of an example of the lid engaged with a container.
Figure 4A:
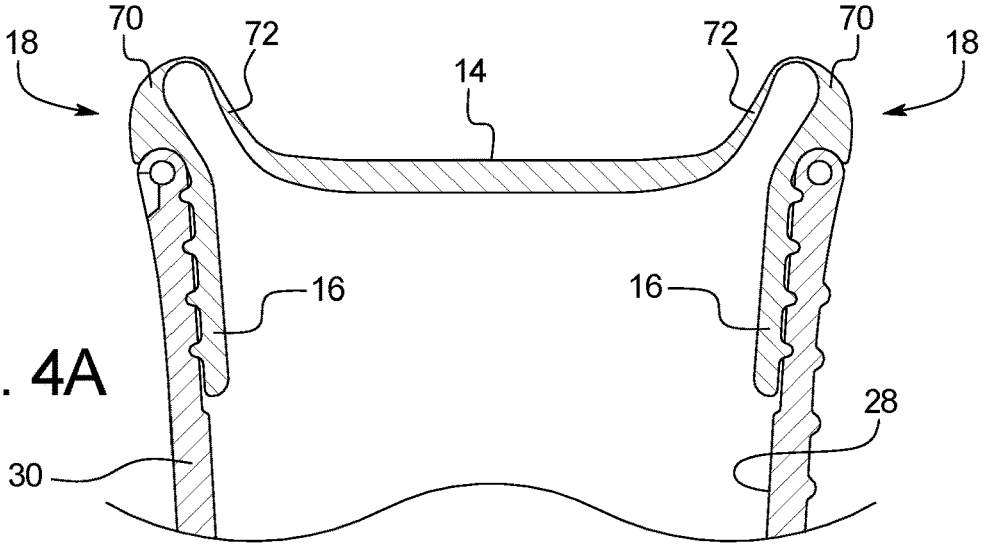
FIG. 4A is a cross sectional view of an example of the lid disclosed herein engaged with a container.
Figure 4B:
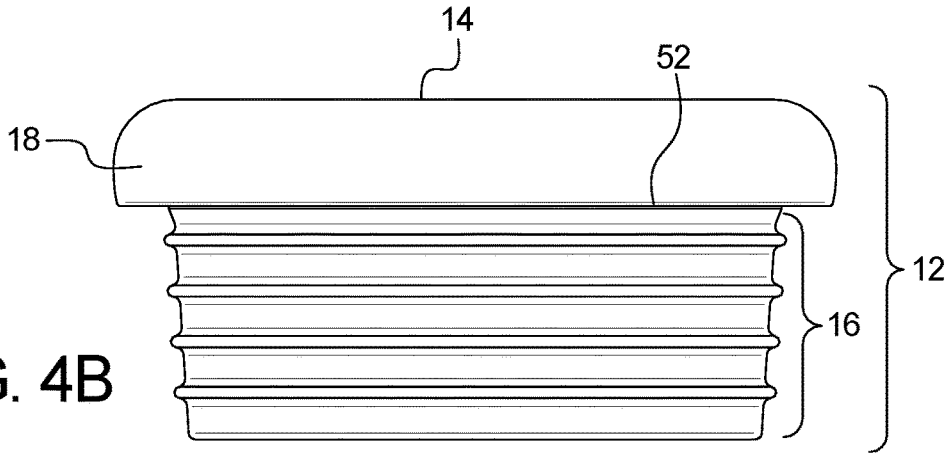
FIG. 4B is a side view of an example of the lid disclosed herein.

As shown in FIGS. 1-3, the present disclosure is directed to a lid 10 for a container 30. Specifically, the lid 10 can include a lid body 12 including a top planar surface 14, a cylindrical mounting base 16 configured to attach to a container 30, and a lip 18 extended from the top planar surface 14, wherein the lid 10 is one-piece. It should be understood the top planar surface 14 does not need to be planar, or perfectly planar. In an example, In an example, as shown in FIGS. 4A-4B, the lip 18 is raised relative to the top planar surface 14. Alternatively, the lip 18 can be co-planar with the top planar surface 14. In an example, the raised lip 18 can exist continually around the circumference of the lid body 12 (i.e., a circumferential lip). Alternatively, the raised lip 18 can exist on a portion of the upper circumference of the lid body 12. The top planar surface 14 and cylindrical mounting base 16 can define an interior cavity 26 of the lid 10 that can be in fluid communication with an inner chamber of a container 30 when the lid 10 is engaged with the container 30.

The lip 18 can include a plurality of slits 20. The slits 20 extend throughout the thickness of the lip, wherein the slits allow fluid to flow through the slits. For example, fluid can pass from the interior cavity 26 of the lid 10 through the slits 20. In other words, the slits 20 can create an opening between the inner cavity 26 of the lid 10 and a user's mouth. The slits 20 can be linear slits or any suitable shape including non-linear shapes, zig-zag, curves, circular, pin holes, among others. In an example, the plurality of slits 20 prevents a vacuum to be created within the container when a user is drinking from the lid.

Figure 5:
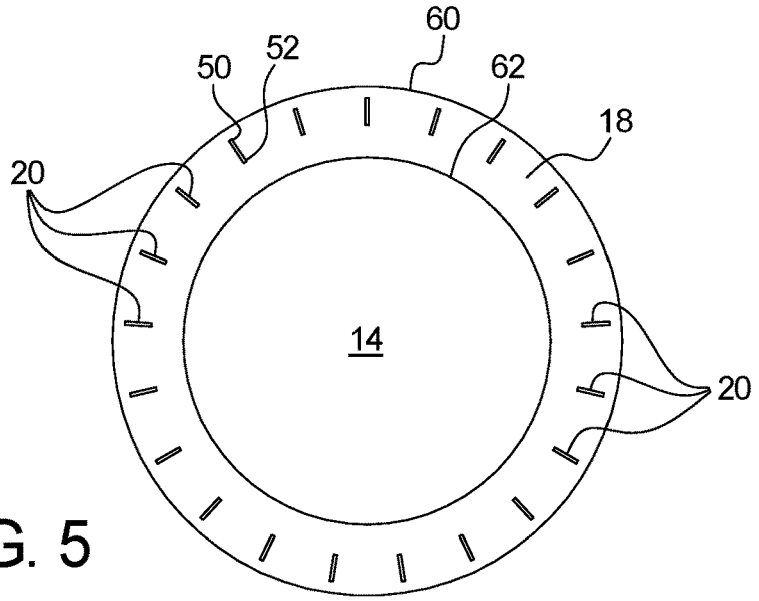
FIG. 5 is a top view of an example of the lid disclosed herein illustrating a plurality of slits.
Figure 6:
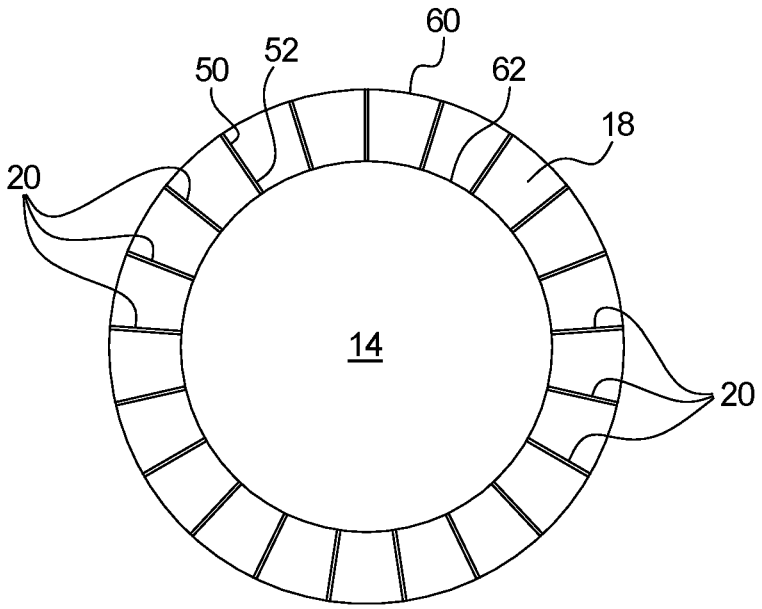
FIG. 6 is a top view of an example of the lid disclosed herein illustrating a plurality of slits from an inner edge to an outer edge of the lip.

The slits 20 can be positioned within the raised lip 18 of the lid 10. As shown in FIG. 5, a first end 50 of the slits can be positioned on a top surface of the lip 18, wherein the second end 52 of the slit is positioned on the top surface of the lip 18 closer to the top planar surface 14. In an example (not shown), the first end 50 of the slits can be positioned on a top surface of the lip 18, wherein the second end 52 of the slit is positioned on an inner edge 62 of the lip 18. In an example, shown in FIG. 6, the first end 50 of the slits 20 can be positioned on an external edge 60 of the lip 18, wherein the second end 52 of the slit 20 is positioned on an inner edge 62 of the lip 18. The slits 20 can be positioned radially out from the center of the top planar surface. Alternatively, the slits 20 can be curved such that the slits 20 are relatively concentric with the curvature of the raised lip 18.

The slits 20 can remain closed until a user drinks from the slits 20 wherein liquid from the container 30, via the inner cavity 26, can be accessed through the slits 20. For example, a user can drink from the slits 20 by drawing the liquid through the slits by making a partial vacuum. However, in an example, liquid cannot flow out of the slits 20 without the pressure drop from drinking, even when the container engaged with the lid 10 is tilted or inverted. In other words, the lid 10 is a no-spill lid that prevents liquid from emerging out of the lid when the liquid flow is not desired, i.e., when the user is not drinking.

In an example, a user can place his or her mouth against the lip 18 of the lid to slightly bite down on the lip to drink liquid out when desired. The act of biting down on the lip 18 and/or compression of the lip 18 with the tongue causes the slits 20 to partially open to provide access to the liquid. When not in use, the slits 20 rest in a closed position in which fluid is securely blocked from passage out of the lid. Only when a user provides negative pressure and/or biting the lip 18 can a user access the liquid through the slits 20.

The closed slit position provides a secure seal against fluid leakage, such that inadvertent spills or even deliberate attempts to force liquid outside of the container via the lid, such as by turning the container upside down, or shaking the container, are ineffective. At the same time, the lid is designed to make it very easy for toddlers, children, or adults to comfortably extract the desired amount of liquid.

As a result, the lid provides very secure protection against fluid leakage in drinking products that can be used by individuals of all ages, while still providing a comfortable drinking product. The invention can be used by babies, children of all ages, and adults, and prevents messes whether from an accidentally knocked over product, or other spillage.

The cylindrical mounting base 16 extending from the lip 18 can be configured to attach to a container 30, wherein the cylindrical mounting base 16 can include an outer wall 22 to be inserted within an inner surface 28 of a container 30. The outer wall can fit within the inner surface 28 by a pressure fit. Alternatively, or in addition to, the outer wall 22 can include a plurality of ribs 24 (e.g., parallel ribs around the outer surface of the outer wall 22) to aid in a pressure fit to the inner surface 28 of the container 30. Alternatively, or in addition to, the outer wall 22 can include a threading to engage with the inner surface 28 of the container 30, wherein the inner surface 28 contains compatible threading to receive the lid 10.

The lid 10 can be made of any flexible material, including, but not limited to silicone. Alternatively, a variety of other suitable materials may be utilized as would be recognized by one of ordinary skill in the art. In an example, the entire one-piece lid can be made of silicone.

The lip 18 including the slits 20 can have a thickness that enables enough flexibility for the liquid to release upon drinking, but not so thin to allow tearing of the slits. In an example, the thickness of the lip can be between and including 0.3-0.7 mm, 0.5-0.6 mm, 0.45-0.55 mm, among others.

In an example, an outer wall 70 of the lip 18 creates structure to allow the silicon to be 0.4-0.6 mm (0.5 mm) at the top for the slits, wherein the thickness does not compromise the flow when a user drinks from the lid. An inner portion 72 of the lip 18 can be 0.2-0.5 mm (e.g., 0.3 mm) thick to create structure and integrity.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

We claim:

1. A container lid configured to engage with a container, the lid comprising:

a top planar surface;

a lip positioned around the circumference of the top planar surface;

a cylindrical mounting base extending from an outer edge of the top planar surface, wherein the cylindrical mounting base includes a cylindrical wall, wherein the cylindrical wall is substantially perpendicular to the top planar surface, wherein an outer surface of the cylindrical wall is configured to engage with a portion of an inner surface of an opening of the container, wherein the top planar surface and the cylindrical mounting base form an interior cavity of the lid; and a plurality of slits extending through the thickness of the lip, wherein a first end of the slit is located on an outer surface of the lip, wherein a second end of the slit is located on an inner surface of the lip, wherein the slit is in fluid communication with the interior cavity, wherein, absent negative pressure applied to the slits, the slits remain closed.

2. The container lid of claim 1, wherein the outer surface of the cylindrical wall includes a plurality of ribs extending along at least a portion of the circumference of the outer surface.

3. The container lid of claim 1, wherein engagement between the outer surface of the cylindrical wall and the inner surface of the container forms a waterproof seal.

4. The container lid of claim 1, wherein the lip is raised relative to the top planar surface of the lid.

5. The container lid of claim 1, wherein the plurality of slits within the lip extend radially from an inner edge of the lip to an outer edge of the lip.

6. The container lid of claim 1, wherein the plurality of slits are linear.

7. The container lid of claim 1, wherein the lid is made of silicone.

8. The container lid of claim 1, wherein the lid is one piece of material.

9. The container lid of claim 1, wherein the lip has a thickness of 0.3 mm to 0.7 mm.

* * * * *